US011828068B2

(12) United States Patent
Kurtz

(10) Patent No.: US 11,828,068 B2
(45) Date of Patent: Nov. 28, 2023

(54) BALUSTER ATTACHMENT MECHANISM HAVING SECURING RESILIENT FLANGES

(71) Applicant: Novo Building Products, LLC, Zeeland, MI (US)

(72) Inventor: Craig Kurtz, Bowerston, OH (US)

(73) Assignee: Novo Building Products, LLC, Zeeland, MI (US)

( * ) Notice: Subject to any disclaimer, the term of this patent is extended or adjusted under 35 U.S.C. 154(b) by 226 days.

(21) Appl. No.: 17/535,180

(22) Filed: Nov. 24, 2021

(65) Prior Publication Data

US 2023/0160212 A1 May 25, 2023

(51) Int. Cl.
*E04F 11/18* (2006.01)

(52) U.S. Cl.
CPC ..... *E04F 11/1817* (2013.01)

(58) Field of Classification Search
CPC ..... E04H 17/009; E04H 17/22; E04F 11/18; E04F 11/181; E04F 11/1812; E04F 11/1817; E04F 11/1842; E04F 11/1846; E04F 2011/1819; E04F 2011/1821; E04F 2011/1823; E04F 2011/1825; E04F 2011/1827
See application file for complete search history.

(56) References Cited

U.S. PATENT DOCUMENTS 3,485,006 A * 12/1969 De Rozario ..... F16B 12/40 256/65.01
4,083,641 A * 4/1978 Sado ..... E04F 11/181 403/258
6,012,868 A * 1/2000 Aoki ..... E04F 11/181 403/404

(Continued)

FOREIGN PATENT DOCUMENTS

DE 3920260 A1 * 1/1991
FR 2905134 A1 * 2/2008 ..... E04H 12/2253
GB 2518225 3/2015
KR 200384090 5/2005
KR 200440747 Y1 * 6/2008

OTHER PUBLICATIONS

Home Depot, "Black Square Plastic Baluster Connectors" (2017).
Direct Stair Parts, "Baluster Fastener Kit with Drill Cover C-3201" (2020).
Amazon.com, "Adjustable Angle Connectors for Easy Installation of ½" Hollow Metal Balusters (Screws Included)" (2020).

(Continued)

*Primary Examiner* — Jonathan P Masinick

(74) *Attorney, Agent, or Firm* — Warner Norcross + Judd LLP

(57) ABSTRACT

A multi-directional railing support includes a fastener having a first threaded end that attaches to a substrate and a second threaded end. A securing portion is attached to the second threaded end and includes outwardly extending resilient flanges. The securing portion and the second threaded end define a receiving stud. The securing portion is axially adjustable relative to the second threaded end to adjust a clearance space between the securing portion and the substrate. A baluster includes a hollow end that extends over the outwardly extending resilient flanges of the receiving stud. The outwardly extending resilient flanges cooperate with the hollow end to provide for movement of the baluster toward the substrate and contemporaneously prevent movement of the baluster away from the substrate. The outwardly extending resilient flanges bias the baluster toward a rotational axis of the fastener.

20 Claims, 10 Drawing Sheets

(56) References Cited

U.S. PATENT DOCUMENTS

| | | | | |
|---|---|---|---|---|
| 6,141,928 | A * | 11/2000 | Platt | E04F 11/1814 52/832 |
| 6,718,710 | B2 * | 4/2004 | Platt | E04F 11/1812 52/296 |
| 6,758,460 | B1 | 7/2004 | Driscoll et al. | |
| 7,104,742 | B1 * | 9/2006 | Fitts, III | F16B 43/00 411/389 |
| 7,762,533 | B2 | 7/2010 | Derogatis et al. | |
| 7,971,412 | B1 | 7/2011 | Lim | |
| 8,033,530 | B2 * | 10/2011 | Timothy | E04F 11/181 256/22 |
| 8,348,242 | B2 | 1/2013 | Rock | |
| 9,556,641 | B2 * | 1/2017 | Milanowski | E04F 11/1842 |
| 9,790,689 | B2 | 10/2017 | Milanowski | |
| 9,874,024 | B2 | 1/2018 | Green | |
| 10,060,136 | B2 * | 8/2018 | Milanowski | E04F 11/1817 |
| 10,081,950 | B2 * | 9/2018 | Bizzarri | E04F 11/1836 |
| 10,100,527 | B1 | 10/2018 | Moeller et al. | |
| 10,316,523 | B2 | 6/2019 | Yu | |
| 10,344,483 | B2 * | 7/2019 | Yu | E04F 11/1846 |
| 11,549,279 | B2 * | 1/2023 | Hodgson | E06B 7/082 |
| 2006/0107613 | A1 | 5/2006 | Chung | |
| 2009/0272957 | A1 * | 11/2009 | Nelson | E04F 11/1834 256/65.01 |
| 2012/0079779 | A1 * | 4/2012 | Yasher | E04H 17/08 52/855 |
| 2014/0246639 | A1 * | 9/2014 | Lee | E04F 11/1846 256/65.1 |
| 2020/0040587 | A1 * | 2/2020 | Yu | E04F 11/1812 |
| 2020/0284041 | A1 * | 9/2020 | Legault | F16B 7/0446 |
| 2022/0243477 | A1 * | 8/2022 | Barnds | E04F 11/1817 |

OTHER PUBLICATIONS

Amazon.com, "Surface Mount Stair Rail Adapter Connectors for ¾" Square Balusters" (2020).

Youtube.com, "Cooper Stairworks Tips & Techniques—Installing Balusters Using Threaded Inserts" (2012).

* cited by examiner

BALUSTER ATTACHMENT MECHANISM HAVING SECURING RESILIENT FLANGES

FIELD OF THE DEVICE

The present device generally relates to stair construction in attachment balusters to treads for a stairway. More specifically, the present device generally relates to a receiving stud for attaching a baluster to a stair support and for mounting a baluster thereto to provide a secure interface for attaching a railing to the stairway. The receiving stud can be utilized for attaching balusters to treads or to stringers and can be inserted within the stairway at a variety of angles to provide for a range of angular orientations of the baluster with respect to the stairway.

BACKGROUND OF THE INVENTION

Stairways within residential and commercial settings include railings that provide safety features for those utilizing the stairway. Balusters are typically used for attaching the railing to the stairway, where balusters include a plurality of vertical or angled members that secure the railing to treads or stringers for the stairway.

SUMMARY OF THE INVENTION

According to a first aspect of the present disclosure, a multi-directional railing support includes a fastener having a first threaded end that attaches to a substrate and a second threaded end. A securing portion is attached to the second threaded end and includes outwardly extending resilient flanges. The securing portion and the second threaded end define a receiving stud. The securing portion is axially adjustable relative to the second threaded end to adjust a clearance space between the securing portion and the substrate. A baluster includes a hollow end that extends over the outwardly extending resilient flanges of the receiving stud. The outwardly extending resilient flanges cooperate with the hollow end to provide for movement of the baluster toward the substrate and contemporaneously prevent movement of the baluster away from the substrate. The outwardly extending resilient flanges bias the baluster toward a rotational axis of the fastener.

According to a second aspect of the present disclosure, a method for installing a railing for a stairway includes determining an angle of a substrate with respect to a horizontal plane. A first threaded end of a fastener is attached to a substrate to orient a rotational axis of the fastener to be perpendicular to the horizontal plane. The fastener is positioned at a predefined insertion depth relative to the substrate. A securing portion is threadably adjusted along a second threaded end of the fastener to define a receiving stud that extends from the substrate. The second threaded end extends through the securing portion. A position of the securing portion is adjusted relative to the first threaded end to define a clearance space between the securing portion and the substrate. A hollow end of a baluster is slid over the receiving stud. An outwardly extending resilient flange of the securing portion is biased against an inner surface of the hollow end to generate an outward securing force of the outwardly extending resilient flange that aligns the baluster with a rotational axis of the fastener. The baluster is positioned on the receiving stud to align with a plurality of adjacent balusters. A railing is installed on a railing end of the baluster.

According to a third aspect of the present disclosure, a method for installing a railing for a stairway includes positioning a securing portion of a receiving stud on a threaded fastener. The threaded fastener is attached to a substrate. The fastener is positioned within the substrate to define a minimum clearance space between an outwardly extending resilient flange of the securing portion and the substrate. A hollow end of a baluster is placed onto the receiving stud to engage the outwardly extending resilient flange with an interior surface of the hollow end. Tabs of the outwardly extending resilient flange are biased in an inward direction to generate an outward securing force of the receiving stud that allows movement of the baluster toward the substrate and aligns the baluster with a rotational axis of the fastener and also prevents movement of the baluster away from the substrate. The baluster is positioned on the receiving stud to align with a plurality of adjacent balusters. A railing is installed on a railing end of the baluster.

These and other aspects, objects, and features of the present disclosure will be understood and appreciated by those skilled in the art upon studying the following specification, claims, and appended drawings.

DETAILED DESCRIPTION OF THE PREFERRED EMBODIMENTS

As required, detailed embodiments of the present disclosure are disclosed herein; however, it is to be understood that the disclosed embodiments are merely exemplary of the invention that may be embodied in various and alternative forms. The figures are not necessarily to a detailed design; some schematics may be exaggerated or minimized to show function overview. Therefore, specific structural and functional details disclosed herein are not to be interpreted as limiting, but merely as a representative basis for teaching one skilled in the art to variously employ the present invention.

Figure 1:
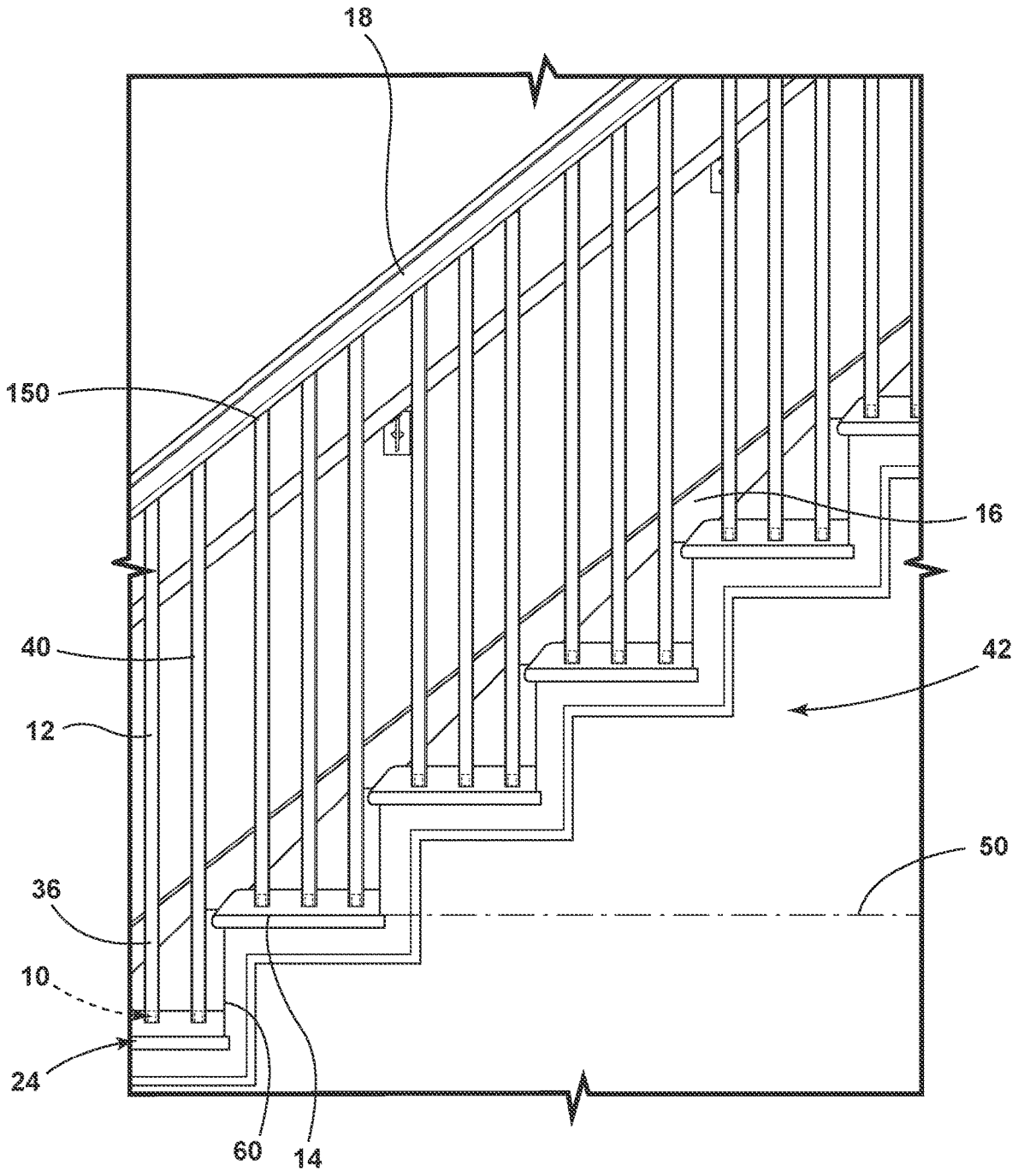
FIG. 1 is a side elevational view of a stairway that incorporates an aspect of a railing support for attaching a railing to treads for a stairway.
Figure 2:
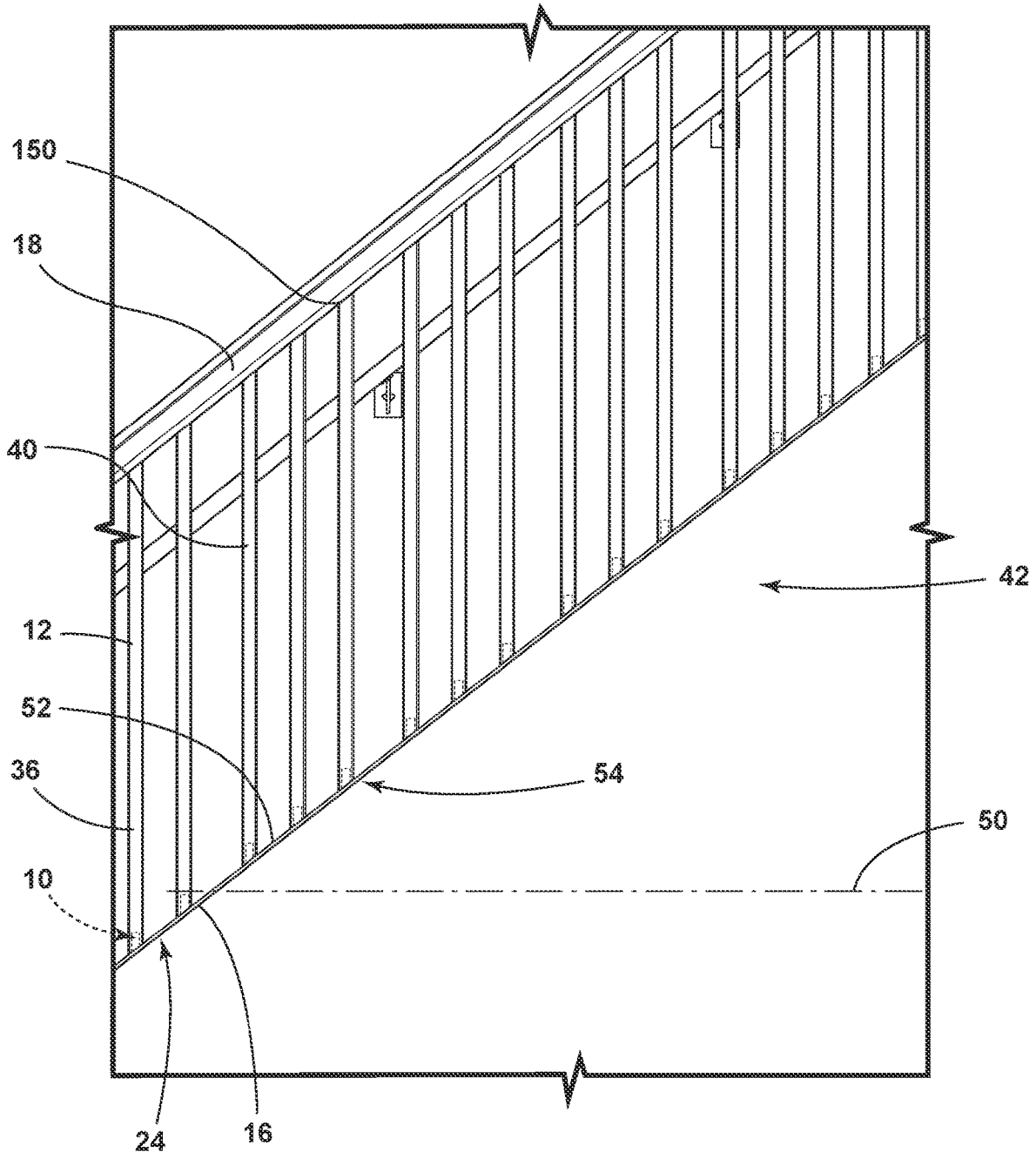
FIG. 2 is a side elevational view of a stairway that incorporates an aspect of a railing support for attaching a railing to an angled stringer for a stairway.
Figure 3:
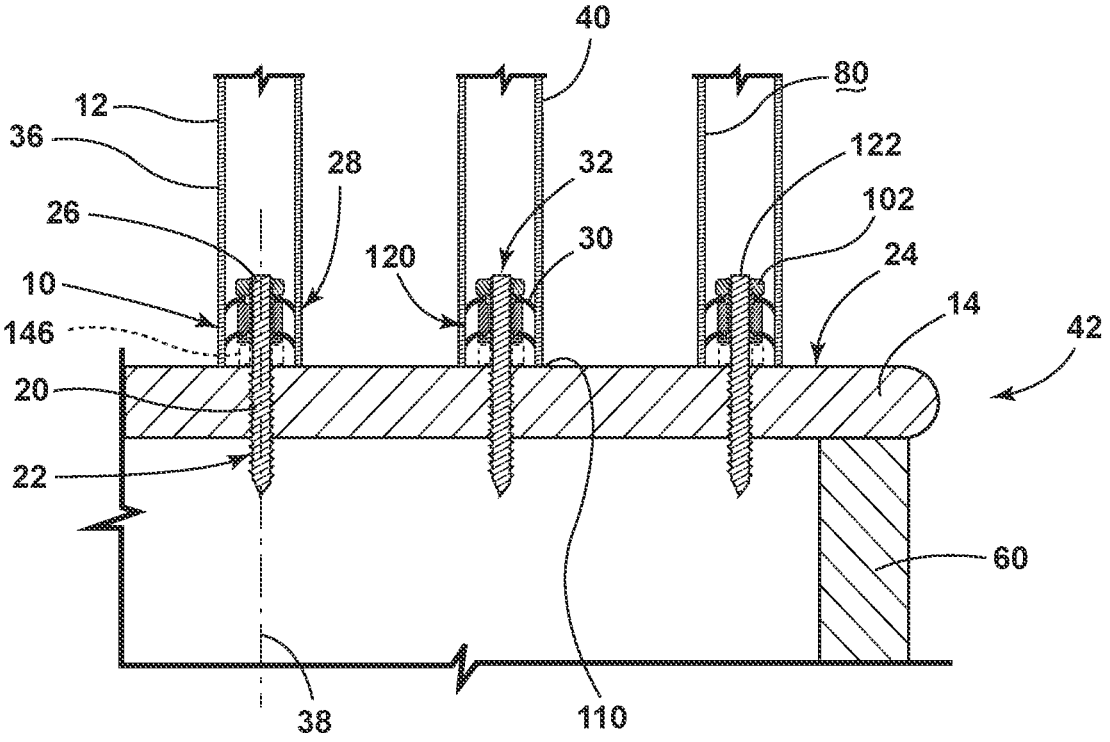
FIG. 3 is a cross-sectional view of an aspect of the railing support showing attachment of the baluster to a tread for a stairway.
Figure 4:
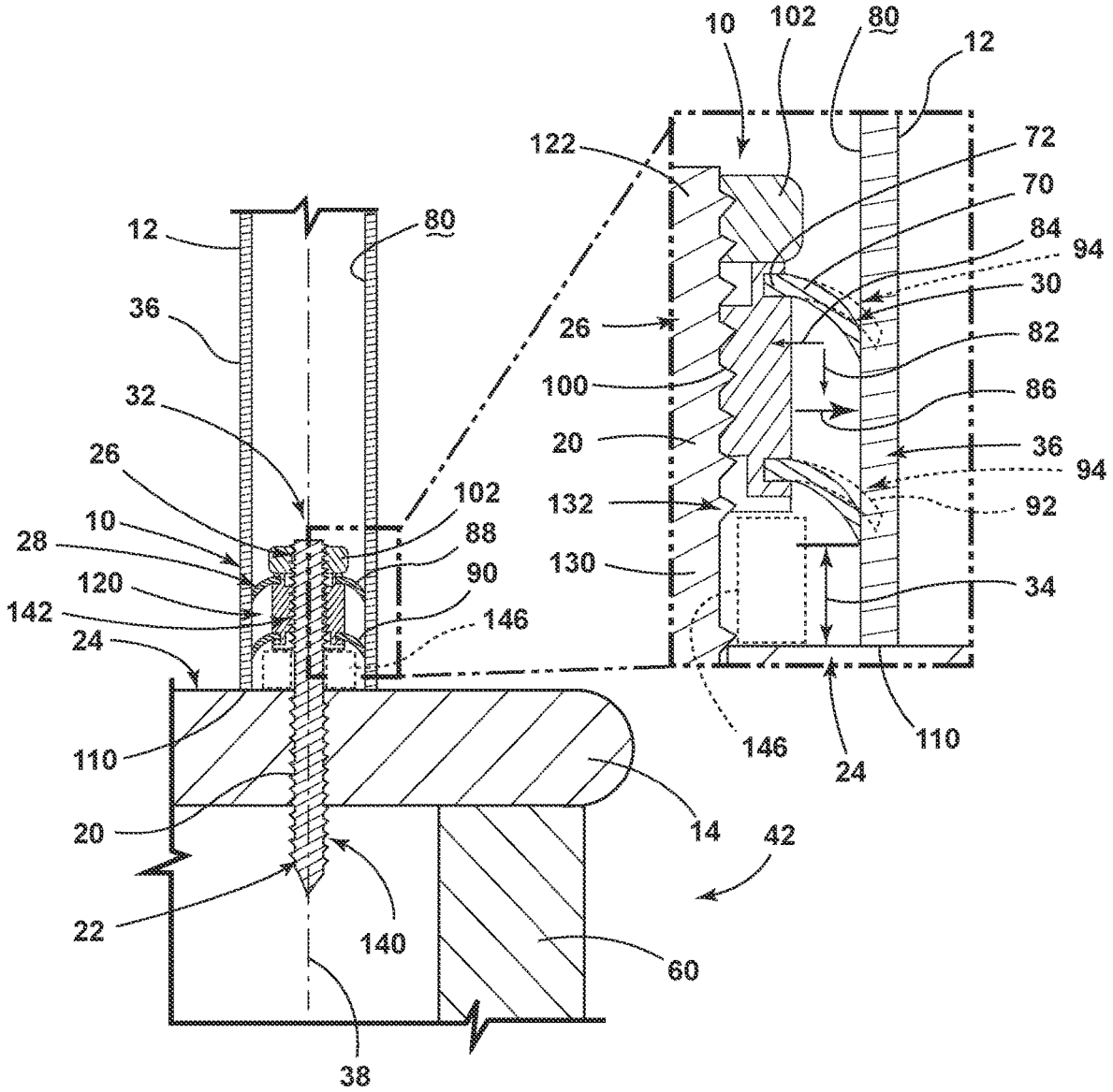
FIG. 4 is an enlarged cross-sectional view of the railing support of FIG. 3.
Figure 5:
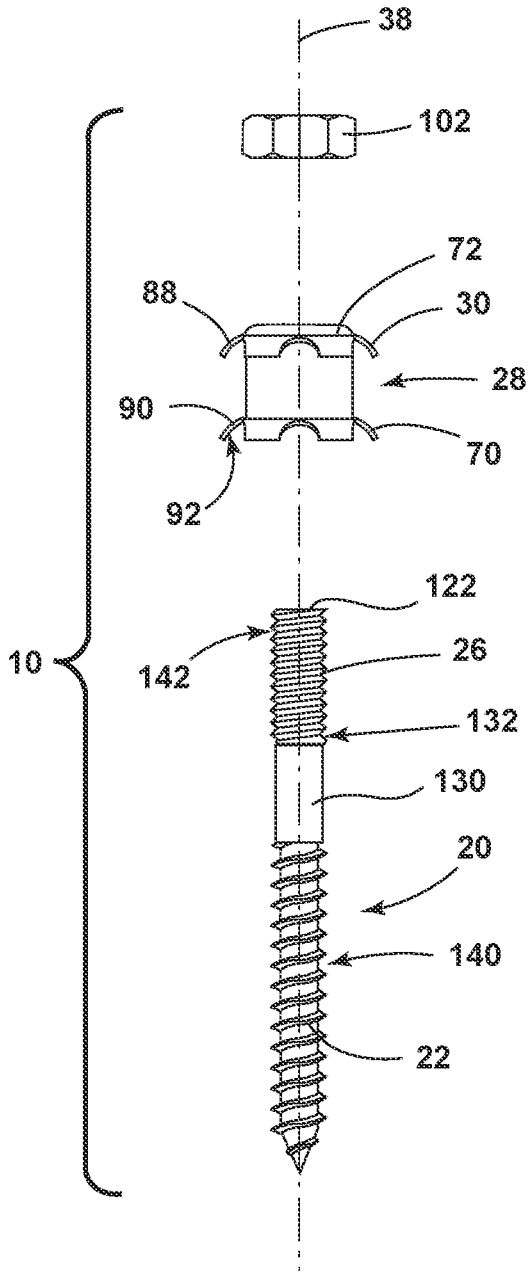
FIG. 5 is an exploded perspective view of an aspect of the railing support.
Figure 6:
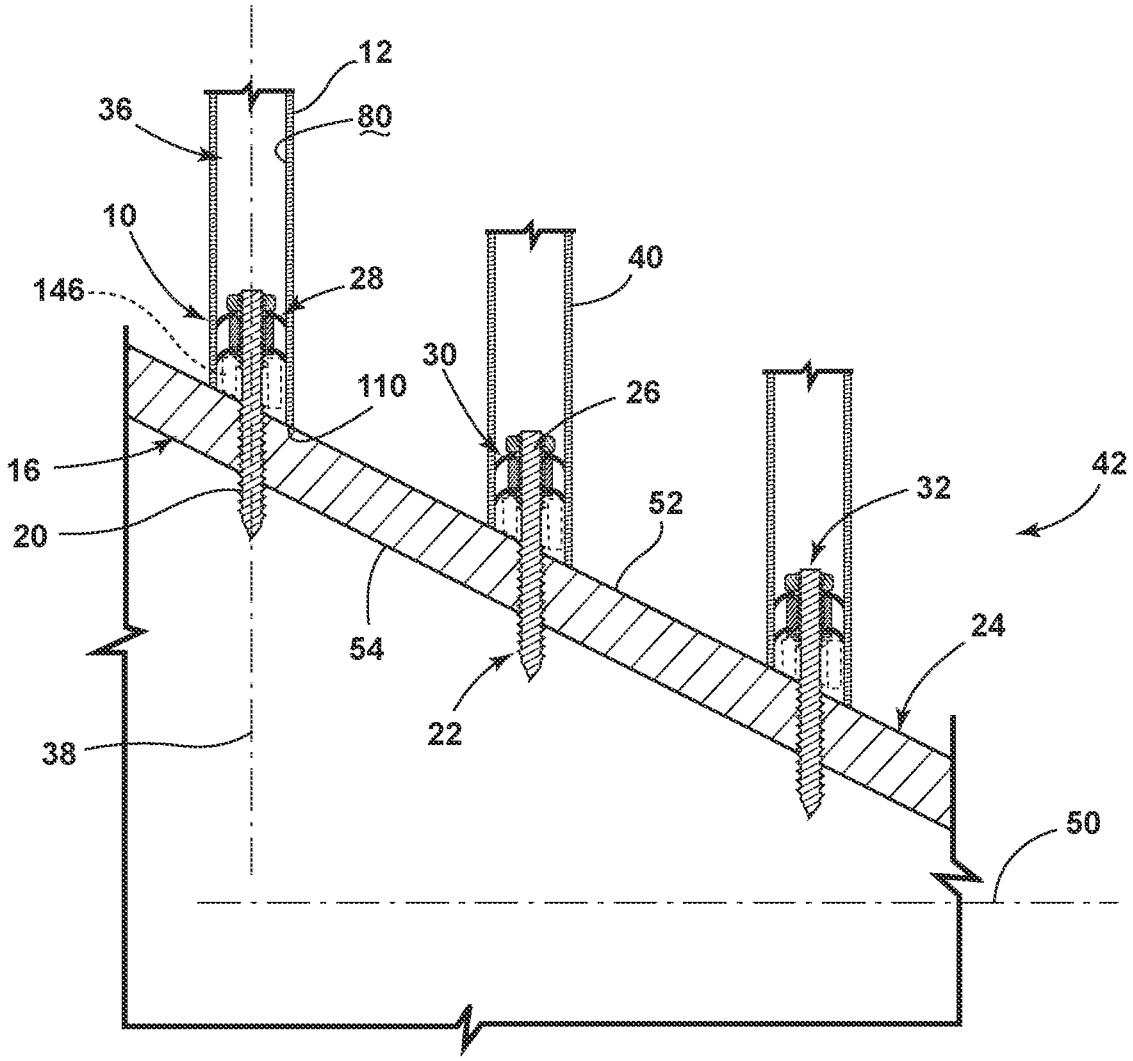
FIG. 6 is a detail cross-sectional view showing an aspect of a railing support for attaching balusters for a railing to a stringer for a stairway.
Figure 7:
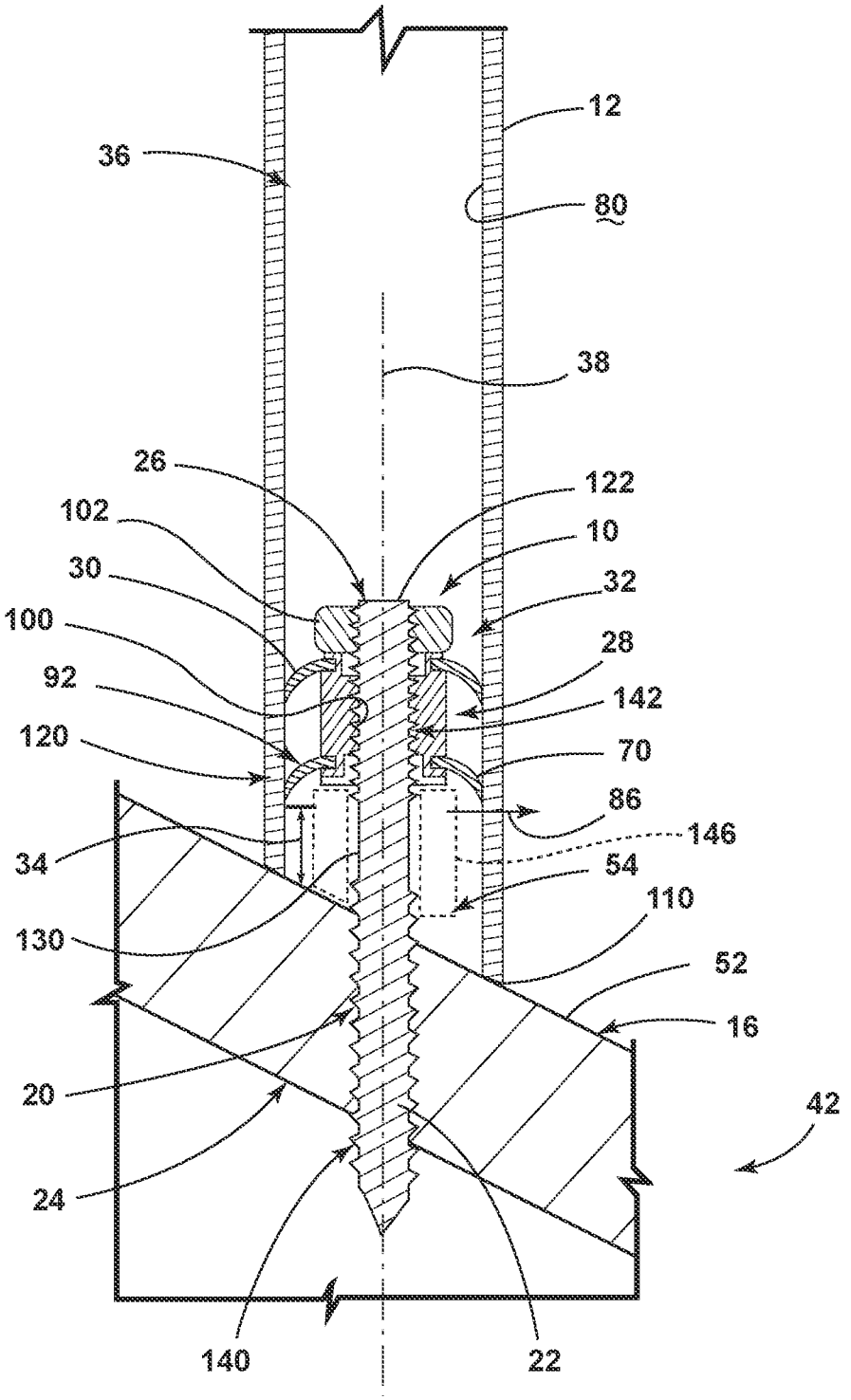
FIG. 7 is an enlarged cross-sectional view of the railing support of FIG. 6.
Figure 8:
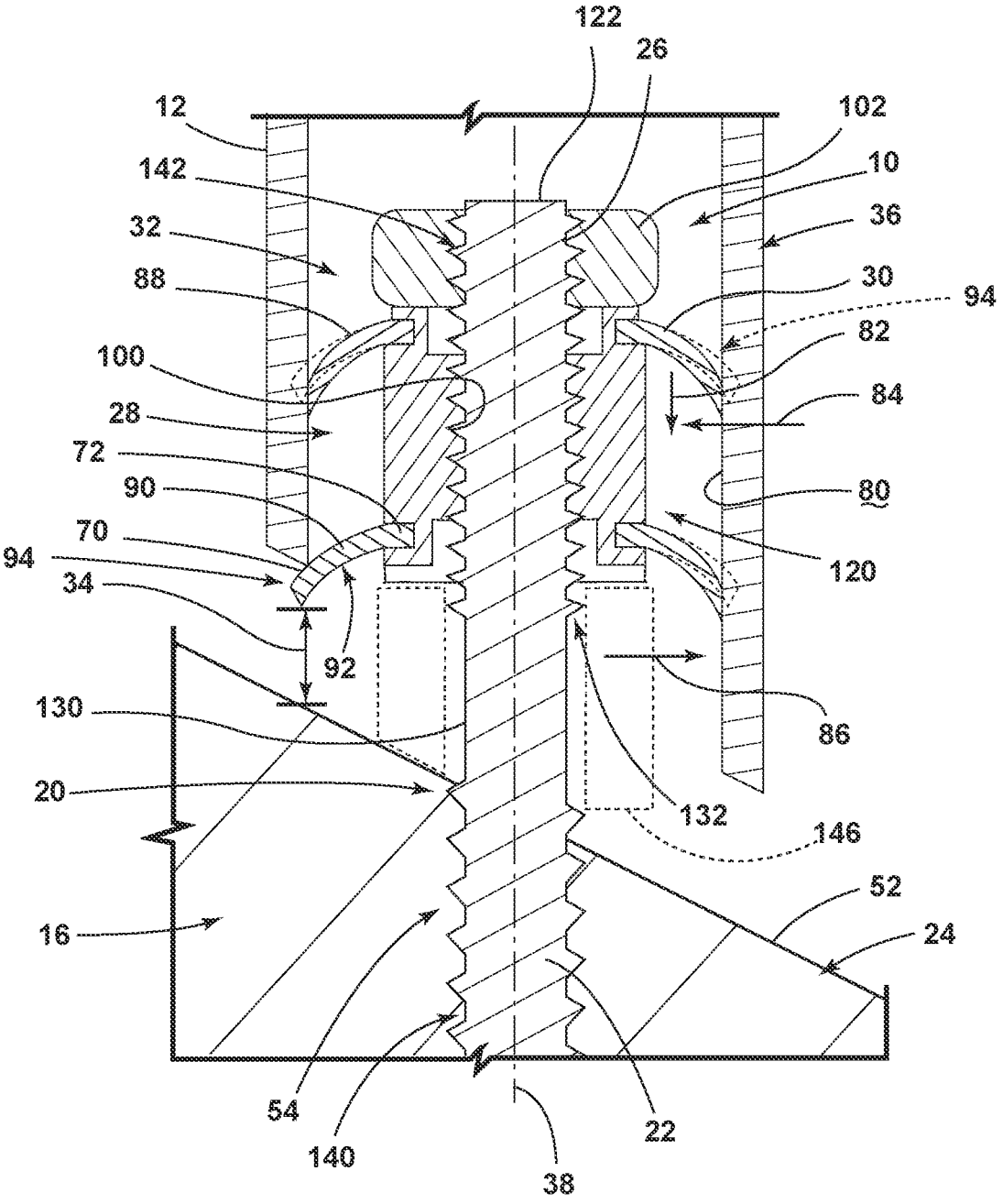
FIG. 8 is a schematic cross-sectional view of the railing support showing installation of a baluster onto the receiving stud having the outwardly extending resilient flanges.
Figure 9:
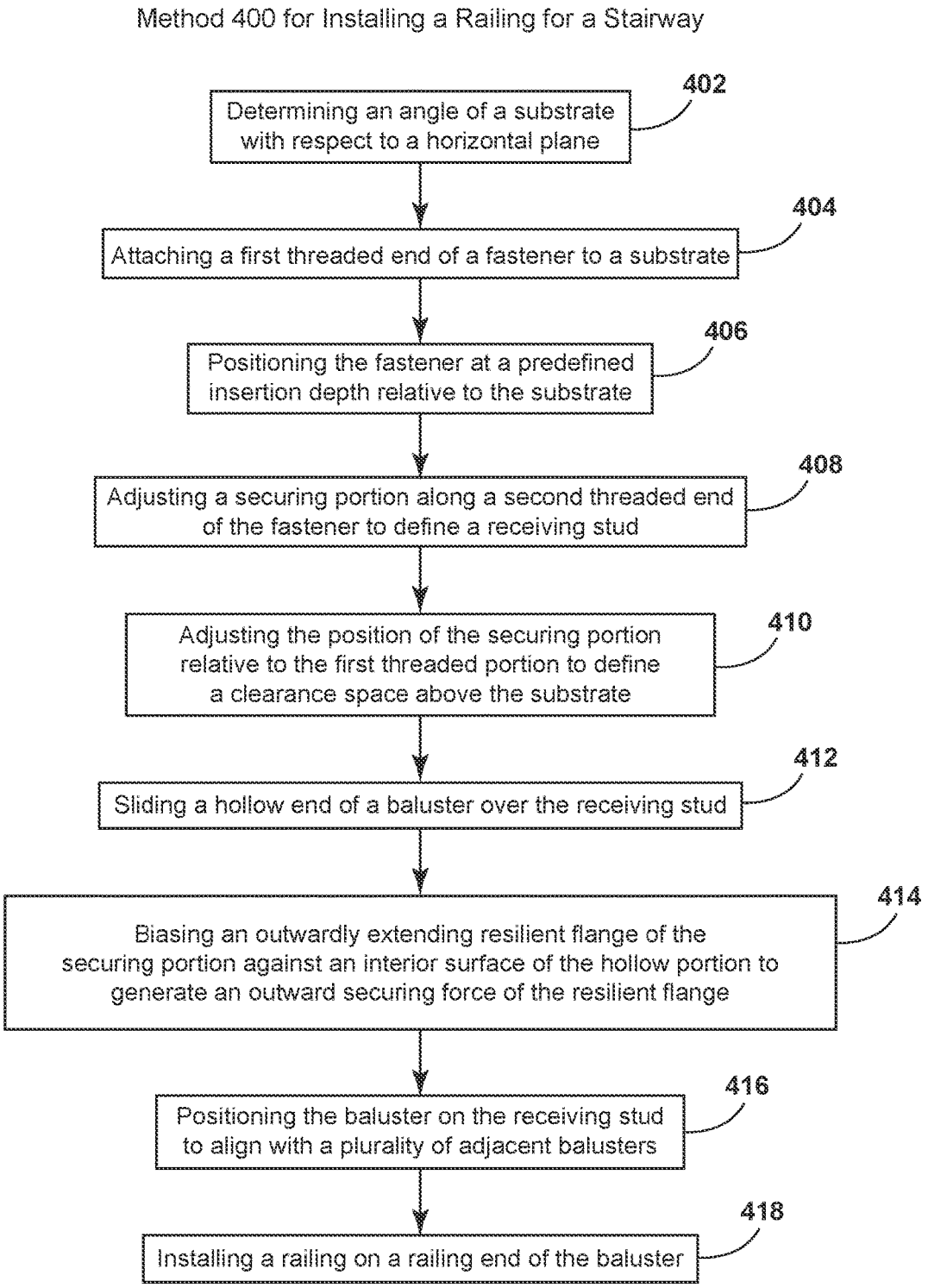
FIG. 9 is a schematic flow diagram illustrating a method for installing a railing on a stairway.
Figure 10:
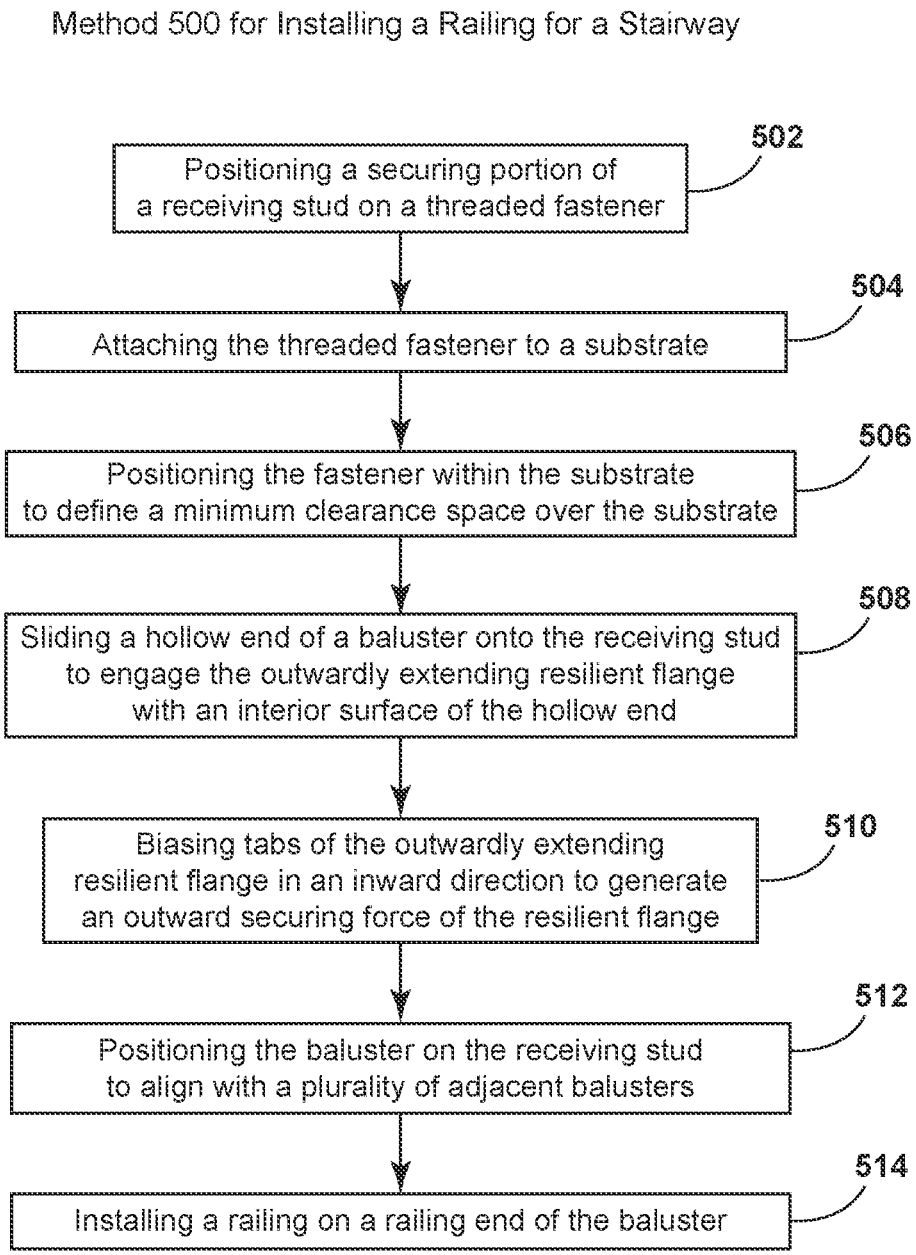
FIG. 10 is a schematic flow diagram illustrating a method for installing a railing on a stairway.

For purposes of description herein, the terms "upper," "lower," "right," "left," "rear," "front," "vertical," "horizontal," and derivatives thereof shall relate to the concepts as oriented in FIG. 1. However, it is to be understood that the concepts may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The present illustrated embodiments reside primarily in combinations of method steps and apparatus components related to a railing support that attaches to a tread or a stringer for a stairway and provides a robust and adjustable support that can be used in a range of angular orientations for maintaining a positon of a baluster during installation of a railing for a stairway. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

As used herein, the term "and/or," when used in a list of two or more items, means that any one of the listed items can be employed by itself, or any combination of two or more of the listed items, can be employed. For example, if a composition is described as containing components A, B, and/or C, the composition can contain A alone; B alone; C alone; A and B in combination; A and C in combination; B and C in combination; or A, B, and C in combination.

In this document, relational terms, such as first and second, top and bottom, and the like, are used solely to distinguish one entity or action from another entity or action, without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

As used herein, the term "about" means that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art. When the term "about" is used in describing a value or an end-point of a range, the disclosure should be understood to include the specific value or end-point referred to. Whether or not a numerical value or end-point of a range in the specification recites "about," the numerical value or end-point of a range is intended to include two embodiments: one modified by "about," and one not modified by "about." It will be further understood that the end-points of each of the ranges are significant both in relation to the other end-point, and independently of the other end-point.

The terms "substantial," "substantially," and variations thereof as used herein are intended to note that a described feature is equal or approximately equal to a value or description. For example, a "substantially planar" surface is intended to denote a surface that is planar or approximately planar. Moreover, "substantially" is intended to denote that two values are equal or approximately equal. In some embodiments, "substantially" may denote values within about 10% of each other, such as within about 5% of each other, or within about 2% of each other.

As used herein the terms "the," "a," or "an," mean "at least one," and should not be limited to "only one" unless explicitly indicated to the contrary. Thus, for example, reference to "a component" includes embodiments having two or more such components unless the context clearly indicates otherwise.

As exemplified in FIGS. 1-8, reference numeral 10 generally refers to a railing support that is used for attaching a baluster 12 to a tread 14 for a stairway 42 or to a stringer 16 for a stairway 42. The baluster 12 extends from the tread 14 or the stringer 16 of the stairway 42 into a railing 18. The railing 18 is placed upon a series of balusters 12 that extend between the stairway 42 and the railing 18. According to the various aspects of the device, the railing support 10 is in the form of a multi-directional railing support 10 that can be oriented onto a tread 14 or oriented onto a stringer 16 that is typically positioned at an angle with respect to the treads 14 for a stairway 42. The railing support 10 includes a fastener 20 having a first threaded end 22 that attaches to a substrate 24 and a second threaded end 26. The substrate 24 is in the form of a tread 14, stringer 16, or other portion of the stairway 42 that receives one or more balusters 12. A securing portion 28 is attached to the second threaded end 26 of the fastener 20 and includes outwardly extending resilient flanges 30. The securing portion 28 and the second threaded end 26 define a receiving stud 32 that extends upward from the substrate 24. The securing portion 28 is axially adjustable relative to the second threaded end 26 to adjust a clearance space 34 that extends between the securing portion 28 and the substrate 24. A baluster 12 having a hollow end 36 extends over the outwardly extending resilient flanges 30 of the receiving stud 32. The outwardly extending resilient flanges 30 cooperate with the hollow end 36 of the baluster 12 to provide for movement of the baluster 12 towards the substrate 24. Contemporaneously, the outwardly extending resilient flanges 30 of the receiving stud 32 prevent movement of the baluster 12 away from the substrate 24. In addition to providing for a one-way movement of the baluster 12 towards the substrate 24, the resilient flanges 30 also bias the baluster 12 toward a rotational axis 38 of the fastener 20 to provide for more convenient installation of the railing 18 onto the baluster 12 as well as the adjacent balusters 40 for the stairway 42.

The multi-directional configuration of the railing support 10 provides for installation of the railing support 10 onto the treads 14 for a stairway 42 which are typically oriented along a horizontal plane 50. Stringers 16 for the stairway 42, which helps to support the risers 60, treads 14, and the stairway 42 in general, can be at an oblique angled orientation 54 with respect to the treads 14, particularly in the case of a closed stringer 16. The multi-directional railing supports 10 can be installed within the upper edge 52 of the stringer 16 and at an angle with respect to the stringer 16 to provide for an angular installation of the baluster 12 with respect to the treads 14 for the stairway 42. Accordingly, the multi-directional railing support 10 can be installed into a stairway 42 at a plurality of angled orientations 54 with respect to the treads 14 for the stairway 42. In addition, the multi-directional railing supports 10 can be installed into the treads 14 for the stairway 42 at an angle to provide for an angled orientation 54 of balusters 12 that can be used in certain configurations and designs for stairways 42.

Referring again to FIGS. 1-8, a typical stairway 42 includes a plurality of treads 14 that are vertically separated by risers 60 to define the stepping surfaces of the stairway 42. The stringers 16 are positioned at opposing sides of the treads 14 and risers 60 and extend from one floor to another, from a floor to a landing, or from a landing to another floor. As discussed herein, an upper edge 52 of a stringer 16 is typically at an oblique angled orientation 54 with respect to the treads 14 and risers 60 for the stairway 42. The balusters 12 extend from the treads 14 or from the stringers 16 to receive the railing 18 and also to support the railing 18 relative to the stairway 42. The railing 18 is typically supported at either end by a vertical structure, such as a wall, newel, or other similar vertical structural element. Due to the length of the railing 18, it is important to align the various balusters 12 with the railing 18. This process can cause undue stress to be exerted upon the balusters 12 and the substrate 24. The flexibility of the receiving stud 32 and the resilient flanges 30 of the receiving stud 32 help to align the balusters 12 in a particular orientation and minimize stresses that are placed upon the balusters 12 when the railing 18 is attached to the stairway 42. At the same time, it is important to provide a robust structure at the base or hollow end 36 of the baluster 12 to prevent inadvertent breakage of the baluster 12 or the railing support 10 therefor during installation of the baluster 12 and/or the railing 18. Using the receiving stud 32 having the resilient flanges 30 as well as the interior structure provided by the fastener 20, the receiving stud 32 provides internal structure as well as limited amount of flexibility to accomplish each of these goals. To provide this flexibility, the resilient flanges 30 can be made of spring steel, various elastomeric materials, polymers, and other similarly sturdy but flexible material.

Referring again to FIGS. 3-8, the outwardly extending resilient flanges 30 include a plurality of tabs 70 that extend radially outward from the securing portion 28. These plurality of tabs 70 can be in the form of individual tabs 70 that extend outward from the securing portion 28 or can be scalloped undulations that extend outward from an inner ring 72 of the outwardly extending resilient flanges 30.

As exemplified in FIGS. 3-8, the hollow end 36 of the baluster 12 slides over the securing portion 28. In this manner, an inner surface 80 of the hollow end 36 presses down on and biases the plurality of tabs 70 in a generally downward direction 82 and inward direction 84 as the baluster 12 is installed on the receiving stud 32. This installation of the baluster 12 over the tabs 70 and the movement of the tabs 70 in the generally downward and inward directions 82, 84, generates an outward securing force 86 of the plurality of tabs 70 with respect to the baluster 12. Stated another way, as the inner surface 80 of the hollow end 36 biases the plurality of tabs 70 downward, the tabs 70, being resilient members, are biased toward their original shape 94. These opposing forces exerted by the inner surface 80 of the hollow end 36 of the baluster 12 and the material of the resilient flanges 30 provides the outward securing force 86 that prevents movement of the baluster 12 away from the substrate 24 and also biases the baluster 12 to align, at least generally, with a rotational axis 38 of the fastener 20. To assist in aligning the baluster 12 with the rotational axis 38 of the fastener 20, and also for providing a greater degree of the outward securing force 86, the securing portion 28 can include an upper flange 88 and a lower flange 90 that each extend in a generally angled direction 92, downward, towards the first threaded end 22.

As discussed herein, the orientation of the resilient flanges 30 in the angled direction 92 serves to allow for the one-directional movement of the baluster 12, over the receiving stud 32, and toward the substrate 24. The material of the resilient flanges 30, in combination with the outward securing force 86 of the plurality of tabs 70, provides a high degree of frictional resistance that prevents the movement of the baluster 12 away from the substrate 24 relative to the securing portion 28 of the railing support 10.

Referring again to FIGS. 3-8, the securing portion 28 includes a threaded interior 100 that threadably operates relative to the second threaded end 26 of the fastener 20. The securing portion 28 is secured to the second threaded end 26 at least by a threaded cap 102. In certain aspects of the device, the threaded cap 102 can include a nut that rotationally and threadably engages the second threaded end 26 of the fastener 20. This nut can be a hexnut, lock nut, cap nut, square nut, or other similar threadable fastener 20.

Referring again to FIGS. 3-8, the shape of the outwardly extending resilient flanges 30 can vary depending upon the design of the railing support 10 as well as the design for the baluster 12 that will be received on the railing support 10. Typically, the resilient flanges 30 will extend radially about the securing portion 28 to form a generally circular configuration. With this configuration, when the hollow end 36 of the baluster 12 is placed over the securing portion 28, the plurality of tabs 70 of each of the resilient flanges 30 will exert a generally equalized outward securing force 86 onto the various portions of the inner surface 80 of the hollow end 36 for the baluster 12. These generally equalized outward securing forces 86 exerted by the plurality of tabs 70 helps to center the baluster 12 onto the securing portion, and also to align the baluster 12 with the rotational axis 38 of the fastener 20. Movement of the baluster 12 away from the rotational axis 38 causes a certain portion of the tabs 70 to deflect a greater distance and, thereby, exert a greater outward securing force 86. Simultaneously, opposing tabs 70 will typically move slightly toward the original shape 94 of the tabs 70 and, thereby, exert a lesser outward securing force 86. These differences in the magnitude of the outward securing forces 86 exerted by the various tabs 70 causes the baluster 12 to return to a position that is generally aligned with the rotational axis 38 of the fastener 20.

According to various aspects of the device, the securing portion 28 can include the upper flange 88 and the lower flange 90 that each extend outward from the securing portion 28. It is contemplated that additional flanges can be disposed on the securing portion 28 to provide additional outward securing forces 86 with respect to the inner surface 80 of the hollow end 36 for the baluster 12. As discussed herein, the resilient flanges 30 provide for a one-directional movement of the baluster 12 toward the substrate 24, but not away from the substrate 24. As the hollow end 36 of the baluster 12 is inserted over the securing portion 28, the plurality of tabs 70 of each resilient flange 30 are moved or biased in a downward direction 82 and are positioned closer to the remainder of the securing portion 28 as well as the second threaded end 26 of the fastener 20.

An attempt to move the baluster 12 in a direction away from the substrate 24 generates an increased friction in the form of a binding retention of the baluster 12 with respect to the resilient flanges 30. In order to move the baluster 12 away from the substrate 24, it is typically necessary for the resilient flanges 30 to follow this motion of the baluster 12. Because the flanges are generally angled in a downward orientation toward the substrate 24, and are also further angled downward due to the inward biasing force of the hollow end 36 of the baluster 12, the resilient flanges 30 are not capable of moving in an outward direction, let alone an upward direction, to allow for this movement of the baluster 12 away from the substrate 24. Accordingly, the configuration of the resilient flanges 30 and the binding force created thereby resists movement of the baluster 12 away from the substrate 24. In certain aspects of the device, the hollow end 36 of the baluster 12 can include one or more protrusions that are defined within the inner surface 80 of the baluster 12. These protrusions can interact with and latch with the tabs 70 of the resilient flanges 30 to further prevent movement of the baluster 12 away from the substrate 24.

Referring again to FIGS. 3-8, as discussed above, the inner surface 80 of the hollow end 36 for the baluster 12 engages the resilient flanges 30 and biases the resilient flanges 30 in a downward direction 82 and an inward direction 84 and toward the fastener 20. This movement of the plurality of tabs 70 for the resilient fastener 20 are created due to the hollow end 36 of the baluster 12 having a cross-sectional width that is wider than a threaded cap 102 for the railing support 10 but narrower in width than the width of the outwardly extending resilient flanges 30 and the tabs 70 therefor. Accordingly, the hollow end 36 of the baluster 12 can easily fit over the threaded cap 102 for the railing support 10 to provide an initial alignment mechanism for installing the baluster 12 onto the railing support 10. The downward direction 82 of the various tabs 70 of the resilient flanges 30 in the angled direction 92 receive and align a lower edge 110 of the hollow end 36 of the baluster 12 to be generally centered on the fastener 20 and the remainder of the railing support 10. Accordingly, the railing support 10 includes a generally narrower width at a top of the railing support 10 that widens to a maximum width at the resilient flanges 30. This alignment mechanism of the railing support 10 provides for a convenient installation mechanism and alignment mechanism when installing the baluster 12 relative to the railing support 10.

As discussed herein, and as exemplified in FIGS. 1-8, the fastener 20 and the railing support 10 can be installed in a variety of angular orientations with respect to the stairway 42. These angular orientations can be useful in attaching the railing support 10 to treads 14 for the stairway 42, stringers 16 for the stairway 42, or installing the railing support 10 at an angle with respect to the treads 14 or stringers 16 for the stairway 42. In order to place the railing support 10 at an angle with respect to the stringer 16, it may be necessary to adjust the axial position 120 of the securing portion 28 with respect to the fastener 20 in order to provide a sufficient clearance space 34 between the securing portion 28 of the substrate 24, such as the stringer 16. The adjustment of this clearance space 34 ensures that the hollow end 36 of the baluster 12 engages each resilient flange 30 of the securing portion 28 to properly align the baluster 12 on the respective railing support 10. If the resilient flange 30 is positioned too close to the substrate 24, a clearance space 34 that is too small may prevent the hollow end 36 of the baluster 12 from engaging that portion of the resilient flange 30. Accordingly, the securing portion 28 can be threadably operated to move closer to an upper end portion 122 of the second threaded end 26 so that the securing portion 28 is placed farther from the first threaded end 22.

According to the various aspects of the device, the fastener 20 includes a central band 130 that is positioned between the first threaded end 22 and the second threaded end 26. The central band 130 typically defines a lower position 132 of the securing portion 28 relative to the first threaded end 22. As discussed above, the securing portion 28 is threadably operable and axially operable relative to the second threaded end 26 to provide a sufficient clearance space 34 between the securing portion 28 and the substrate 24. The central band 130 typically includes no threads such that the central band 130 defines a lowest position of the securing portion 28 relative to the fastener 20. Operation of the securing portion 28 relative to the second threaded end 26 can be accompanied by a similar operation of the threaded cap 102 that can be used to secure the position of the securing portion 28 relative to the second threaded end 26 of the fastener 20. Accordingly, operation of the securing portion 28 may be accomplished through an initial movement of the threaded cap 102 away from the securing portion 28. Subsequently, the securing portion 28 can then be rotated toward the threaded cap 102. When these two features engage one another, the securing portion 28 can be placed in a fixed position or temporarily fixed position with respect to the second threaded end 26 of the fastener 20.

According to the various aspects of the device, the first threaded end 22 typically includes a first thread configuration 140 that engages the substrate 24. The second threaded end 26 includes a second thread configuration 142 that receives the securing portion 28. Typically, the first thread configuration 140 and the second thread configuration 142 are different from one another. However, the first thread configuration 140 and the second thread configuration 142 can match and be identical. Typically, the first thread configuration 140 of the first threaded end 22 will be similar to that of a wood screw. The second thread configuration 142 of the second threaded end 26 will typically be in a form similar to that of a machine screw.

Adjustment of the securing portion 28 of the railing support 10 can be used to provide for the total concealment of the receiving stud 32 by the baluster 12 and the substrate 24. To accomplish this, as discussed herein, the securing portion 28 is adjustable relative to the second threaded end 26 to ensure that no matter the angled orientation 54 of the fastener 20 and the railing support 10 with respect to the substrate 24, the baluster 12 is able to fully conceal the receiving stud 32 within the hollow end 36 of the baluster 12.

To provide for the total concealment of the receiving stud 32, including the plurality of tabs 70 of the resilient flanges 30, a spacer 146 can be provided between the securing portion 28 and the first threaded end 22 to maintain a minimum clearance space 34 above the substrate 24. The spacer 146 can be used as a visual feedback device to inform an installer when the proper clearance space 34 has been achieved. This spacer 146 can be positioned on the central band 130 and can be slidably operable along the central band 130. By maintaining a minimum amount of clearance space 34, the spacer allows the hollow end 36 of the baluster 12 to slide over the resilient flanges 30 and prevent the resilient flanges 30 from becoming trapped between the lower edge 110 of the baluster 12 and the substrate 24. In turn, the spacer 146 positions the securing portion 28 a sufficient distance above the substrate 24 to prevent this trapping engagement and allow for total concealment of the receiving stud 32. The spacer 146 can be made of various materials. Such materials can include, but are not limited to, rubber, one or more polymers, metal, paper products, combinations thereof and other similar compressible materials that can be used to position the securing portion 28 and define the appropriate clearance space 34 of the securing stud 32.

Referring now to FIGS. 1-9, having described various aspects of the railing support 10, a method 400 is disclosed for installing a railing 18 for a stairway 42. According to the method 400, step 402 includes determining an angle of a substrate 24 with respect to a horizontal plane 50. As discussed herein, the substrate 24 can include a tread 14 that is typically positioned along the horizontal plane 50. The substrate 24 can also include a stringer 16 or other section of the stairway 42 that may be positioned on an angle with respect to the horizontal plane 50. A first threaded end 22 of a fastener 20 is then attached to the substrate 24 to orient a rotational axis 38 of the fastener 20 to be perpendicular to the horizontal plane 50 (step 404). Typically, the balusters 12 are attached to be vertically oriented. It is contemplated that the balusters 12 may also be attached at an angle with respect to the horizontal plane 50 in certain configurations of the stairway 42. The fastener 20 is positioned at a predefined insertion depth relative to the substrate 24 (step 406).

Referring again to FIGS. 1-9, according to the method 400, the securing portion 28 is threadably adjusted along a second threaded end 26 of the fastener 20 to define a receiving stud 32 that extends from the substrate 24 (step 408). The second threaded end 26 extends through the securing portion 28 so that the threaded cap 102 can be positioned on the second threaded end 26 to assist in securing a threaded portion in a particular axial position 120 with respect to the second threaded end 26. The position of the securing portion 28 is adjusted relative to the first threaded end 22 to define a clearance space 34 between the securing portion 28 and the substrate 24 (step 410). As described herein, the clearance space 34 between the securing portion 28 and the substrate 24 can vary depending on the angular orientation of the fastener 20 with respect to the substrate 24. A smaller clearance space 34 may be available where the substrate 24 is a stringer 16 or other angular component of the stairway 42. As exemplified in FIG. 8, this is particularly true toward one side of the securing portion 28 and the tabs 70 that are nearer to the upwardly angled portion of the stringer 16. After the receiving stud 32 is properly positioned, the hollow end 36 of the baluster 12 is slidably positioned over the receiving stud 32 (step 412). The outwardly extending resilient flanges 30 of the securing portion 28 are biased against an inner surface 80 of the hollow portion to generate an outward securing force 86 of the resilient flanges 30 (step 414). This outward securing force 86 serves to align the baluster 12 along a rotational axis 38 of the fastener 20 and also serves to prevent a movement of the baluster 12 away from the substrate 24. The baluster 12 is then positioned on the receiving stud 32 to align the baluster 12 with a plurality of adjacent balusters 40 (step 416). A railing 18 is then installed on the baluster 12 and the plurality of adjacent balusters 40 (step 418).

Referring now to FIGS. 1-8 and 10, having described various aspects of the railing support 10, a method 500 is disclosed for installing a railing 18 for a stairway 42. According to the method 500, a step 502 includes positioning a securing portion 28 of the receiving stud 32 on a threaded fastener 20. The threaded fastener 20 having the securing portion 28 positioned thereon is then attached to the substrate 24 (step 504). The fastener 20 is positioned within the substrate 24 to define a minimum clearance space 34 between an outwardly extending resilient flange 30 of the securing portion 28 and the substrate 24 (step 506). The hollow end 36 of the baluster 12 is then placed onto the receiving stud 32 to engage the outwardly extending resilient flange 30 within the inner surface 80 of the hollow end 36 (step 508). Tabs 70 of the outwardly extending resilient flange 30 are biased in an inward direction 84 to generate the outward securing force 86 of the receiving stud 32 that allows movement of the baluster 12 toward the substrate 24 (step 510). As described herein, the outward securing force 86 also aligns the baluster 12 with a rotational axis 38 of the fastener 20 and prevents movement of the baluster 12 away from the substrate 24. The baluster 12 is positioned on the receiving stud 32 to align with a plurality of adjacent balusters 40 (step 512). The railing 18 is installed on a railing end 150 of each baluster 12 (step 514).

According to the various aspects of the device, the railing support 10 is configured for installation on any one of various components of the stairway 42 to provide a multi-angular orientation that can be used for installing balusters 12 on any one of various surfaces of the stairway 42. In this manner, the railing support 10 provides a universal structural interface that can be used within a range of applications for securing the baluster 12 to any one of various components of the stairway 42. In addition, the configuration of the resilient flanges 30 provides for a securing mechanism and support mechanism that helps to align the balusters 12 with a rotational axis 38 of the fastener 20. In this manner, installation of balusters 12 and attachment of railings 18 to a railing end 150 of each of the balusters 12 can be accomplished by a minimal number of workers, and potentially a single worker. In turn, the installation of balusters 12 and attachment of railings 18 to the balusters 12 can become a far more efficient and less time consuming operation. Also, the configuration of the railing supports 10, as described herein, provides fora single mechanism that can be used regardless of the orientation of the balusters 12 with respect to the stairway 42.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A multi-directional railing support comprising:

a fastener having a first threaded end that attaches to a substrate and a second threaded end;

a securing portion attached to the second threaded end and having outwardly extending resilient flanges disposed within notches formed on the securing portion, wherein the securing portion and the second threaded end define a receiving stud, wherein the securing portion is axially adjustable relative to the second threaded end to adjust a clearance space between the securing portion and the substrate;

a baluster having a hollow end that extends over the outwardly extending resilient flanges of the receiving stud, wherein the outwardly extending resilient flanges cooperate with the hollow end to provide for movement of the baluster toward the substrate and contemporaneously prevent movement of the baluster away from the substrate, and wherein the outwardly extending resilient flanges bias the baluster toward alignment with a rotational axis of the fastener.

2. The multi-directional railing support of claim 1, wherein the outwardly extending resilient flanges are made of spring steel.

3. The multi-directional railing support of claim 1, wherein the outwardly extending resilient flanges include a plurality of tabs that extend radially outward from the securing portion.

4. The multi-directional railing support of claim 3, wherein the outwardly extending resilient flanges includes an upper flange and a lower flange that each extend in a generally angled direction toward the first threaded end.

5. The multi-directional railing support of claim 4, wherein the hollow end of the baluster biases the plurality of tabs inward as the baluster is installed on the receiving stud to generate an outward securing force of the plurality of tabs with respect to the baluster.

6. The multi-directional railing support of claim 5, wherein the outward securing force prevents movement of the baluster away from the substrate and also biases the baluster toward alignment with the rotational axis of the fastener.

7. The multi-directional railing support of claim 1, wherein the securing portion includes a threaded interior that threadably operates relative to the second threaded end and wherein the securing portion is secured to the second threaded end at least by a threaded cap.

8. The multi-directional railing support of claim 7, wherein the hollow end of the baluster includes a cross section that is wider than the threaded cap and narrower than a width of the outwardly extending resilient flanges.

9. The multi-directional railing support of claim 1, wherein the fastener includes a central band that is positioned between the first threaded end and the second threaded end, and wherein the central band defines a lower position of the securing portion relative to the first threaded end.

10. The multi-directional railing support of claim 1, wherein the first threaded end has a first thread configuration that engages the substrate and the second threaded end has a second thread configuration that receives the securing portion.

11. The multi-directional railing support of claim 10, wherein the first thread configuration and the second thread configuration are identical.

12. The multi-directional railing support of claim 1, wherein the receiving stud is configured to be fully concealed by the baluster and the substrate.

13. A method for installing a railing for a stairway, the method comprising steps of:

determining an angle of a substrate with respect to a horizontal plane;

attaching a first threaded end of a fastener to a substrate to orient a rotational axis of the fastener to be perpendicular to the horizontal plane;

positioning the fastener at a predefined insertion depth relative to the substrate;

threadably adjusting a securing portion along a second threaded end of the fastener to define a receiving stud that extends from the substrate, wherein the second threaded end extends through the securing portion;

adjusting a position of the securing portion relative to the first threaded end to define a clearance space between the securing portion and the substrate;

sliding a hollow end of a baluster over the receiving stud;

biasing an outwardly extending resilient flange disposed in a notch of the securing portion against an inner surface of the hollow end to generate an outward securing force of the outwardly extending resilient flange that aligns the baluster with a rotational axis of the fastener;

positioning the baluster on the receiving stud to align with a plurality of adjacent balusters; and installing a railing on a railing end of the baluster.

14. The method of claim 13, wherein the outward securing force provides for movement of the baluster over the outwardly extending resilient flange and toward the substrate and contemporaneously prevents movement of the baluster away from the substrate.

15. The method of claim 14, wherein the outwardly extending resilient flange includes a plurality of tabs that extend radially outward from the securing portion, and wherein the hollow end of the baluster biases the plurality of tabs inward as the baluster is installed on the receiving stud to generate the outward securing force of the plurality of tabs with respect to the baluster.

16. The method of claim 13, wherein the predefined insertion depth of the fastener is defined by a central band of the fastener that is located between the first threaded end and the second threaded end, wherein at least the second threaded end is positioned above the substrate.

17. A method for installing a railing for a stairway, the method comprising steps of:

positioning a securing portion of a receiving stud on a threaded fastener;

attaching the threaded fastener to a substrate;

positioning the fastener within the substrate to define a minimum clearance space between an outwardly extending resilient flange disposed in a notch of the securing portion and the substrate;

placing a hollow end of a baluster onto the receiving stud to engage the outwardly extending resilient flange with an interior surface of the hollow end;

biasing tabs of the outwardly extending resilient flange in an inward direction to generate an outward securing force of the receiving stud that allows movement of the baluster toward the substrate and aligns the baluster with a rotational axis of the fastener and also prevents movement of the baluster away from the substrate;

positioning the baluster on the receiving stud to align with a plurality of adjacent balusters; and installing a railing on a railing end of the baluster.

18. The method of claim 17, wherein the fastener includes a threaded cap that engages an upper end of the securing portion.

19. The method of claim 18, wherein the clearance space is partially defined by an angle of the substrate with respect to the rotational axis of the fastener.

20. The method of claim 19, wherein the substrate is positioned at an oblique angle with respect to the fastener.

* * * * *